United States Patent [19]

Okamura et al.

[11] Patent Number: 4,530,140

[45] Date of Patent: Jul. 23, 1985

[54] OFFSET PREVENTIVE DIFFUSING ROLLERS FOR FIXING ROLLERS FOR ELECTRONIC COPYING MACHINES

[75] Inventors: Shigeo Okamura, Osaka; Yoshihiro Sato, Shinbashi; Kenji Takahashi, Mishima, all of Japan

[73] Assignees: Minolta Camera K.K.; Nitto Kogyo K.K.; Hodaka Kogyo K.K., all of Japan

[21] Appl. No.: 417,929

[22] Filed: Sep. 14, 1982

[30] Foreign Application Priority Data

Sep. 14, 1981 [JP] Japan ..... 56-145138

[51] Int. Cl.[3] ..... B21B 27/02

[52] U.S. Cl. ..... 29/110; 29/132

[58] Field of Search ..... 29/110, 132, 131, 130, 29/129.5, 125, 124, 122, 121.1; 430/98, 99; 432/60; 355/3 FU; 219/216

[56] References Cited

U.S. PATENT DOCUMENTS 4,397,936 8/1983 Sakata et al. ..... 430/98

OTHER PUBLICATIONS

Chow et al., Concept of Composite Rubber Cover on a Soft Roll Fuser for Improved Roll Life, Xerox Disclosure Journal, vol. 7, No. 3, May/Jun. 1982, p. 157.

*Primary Examiner*—Howard N. Goldberg
*Assistant Examiner*—P. W. Echols
*Attorney, Agent, or Firm*—William A. Drucker

[57] ABSTRACT

An offset preventive diffusion roller subsidiary to a fixing roller for electronic copying machines has an oil absorbing layer composed of two kinds of layers. One of the layers is of plural oil diffusing layers for diffusing oil in the axial direction of the roller core. The other layer is of plural oil retaining layers composed of a soft and porous material for retaining oil therein.

11 Claims, 3 Drawing Figures

OFFSET PREVENTIVE DIFFUSING ROLLERS FOR FIXING ROLLERS FOR ELECTRONIC COPYING MACHINES

BACKGROUND OF THE INVENTION

This invention relates to means for preventing taint of copying papers caused during operations of an electronic copying machine which is provided with a fixing roller and a roller subsidiary to said fixing roller, the subsidiary roller diffuses offset preventives throughout the whole cylindrical face of said fixing roller.

Heretofore, means have been known for diffusing offset preventives—silicone oils are mostly used—throughout the cylindrical face of the aforesaid fixing roller by means of a subsidiary roller kept in contact with said fixing roller. In FIG. 2, the aforesaid fixing roller is indicated at "a" and said subsidiary roller in contact with said fixing roller "a" is indicated at "b". Also, in FIG. 2, "c" is a heating roller, "d" is an oil applying roller, "e" is an oil feeding roller, "f" is a felt wick, "g" is an oil reservoir, and "h" is a guide plate for copying papers.

However, in cases where said rollers a and b along the lengths of the same are different from the width of a copying paper in use, oil, due to absorption of oil by said paper, is accumlated at the end portions of said fixing roller with which portions the paper does not come in contact. Therefore, when using a copying paper which is larger in width than the paper which had been fed in the prior copying operations, taint of said new larger paper at the edge portions thereof cannot be avoided.

In view of the above-noted shortcoming in successive copying operations in which copying papers having different widths are used, a roller having an oil absorbing layer has been proposed for the aforesaid subsidiary roller. Such a newly proposed subsidiary roller has been disclosed, for example, in Japanese Published Unexamined Patent Application No. 55-101975. This prior art subsidiary roller has an oil absorbing layer such as made of a paper web or of foamed urethane rubber is shown in FIG. 1 in which such an oil absorbing layer is indicated at "k".

However, the aforesaid shortcoming can hardly be avoided in a comparatively short period of use even when the subsidiary roller having an oil absorbing layer is used. It has now been determined that such an undesirable phenomenon is caused by the fact that the oil absorbing layer of said subsidiary roller becomes saturated with oil far more rapidly at the end portions of said layer than at the middle portions of the same layer. Said end portions of said layer correspond to the end portions of the fixing roller with which copying papers have not been in contact, and said middle portions of said layer correspond to the middle portions of the fixing roller with which portions of said copying papers have been in contact. So, capability to remove oil is lost rapidly at the end portions of said layer.

OBJECTS OF THE INVENTION

It is an object of this invention to provide roller means subsidiary to fixing rollers for electronic copying machines, said subsidiary roller means having a cylindrical layer for diffusing, uniformly throughout the whole face of said fixing roller, offset preventive oil which has been applied to said fixing roller, and to provide said cylindrical layer of said subsidiary roller having an ability for wiping off oil.

It is another object of this invention to provide the aforesaid subsidiary roller which has an ability for diffusing, throughout the whole cylindrical layer of said subsidiary roller, oil which has been applied to the roller face at a limited portion thereof.

It is still another object of this invention to provide a subsidiary roller having an oil absorbing layer which has, as a whole, an ability of retaining a large amount of oil which has been wiped off from said fixing roller.

It is still another object of this invention to provide means for forming said oil absorbing layer from materials available commercially in the market.

It is a further object of this invention to provide means for making said absorbing layer easily and efficiently.

Further objects and merits of this invention will become apparent from the following description taken in connection with the accompanying drawings.

SUMMARY OF THE INVENTION

To achieve the foregoing objects of this invention, an offset preventive diffusing roller according to this invention has a cylindrical oil absorbing layer fixed around a solid cylindrical core which is to be supported rotatably at both ends thereof. The aforesaid oil absorbing layer consists of a number of oil diffusing layers, each of which has fibrous bodies extending in the axial direction of the aforesaid core and a number of oil retaining layers each of which is composed of a homogeneous soft and porous material containing numerous fine spaces or pores scattered throughout said material. Said fine spaces or pores communicate to the faces of said layer and with one another.

Figure 3:
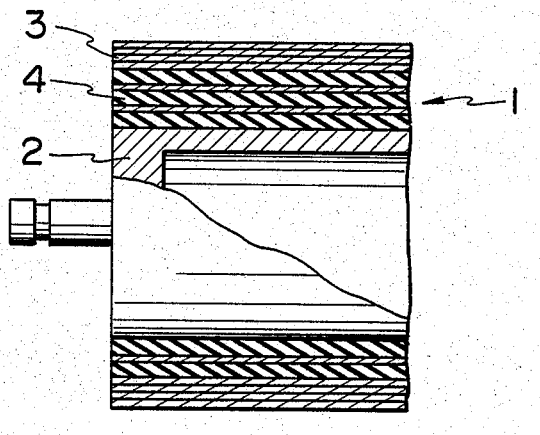

And, FIG. 3 is an axial sectional view of an embodiment according to this invention.

DESCRIPTION OF THE PREFERRED EMBODIMENTS

Referring now to FIG. 3 in which is shown an offset preventive diffusing roller according to this invention, numeral 1 is an oil absorbing layer fixed round a metal core 2. This oil absorbing layer 1 has plural layers 3 of, for example, a long wood pulp paper named HOKI (trade name) made by NIKKO SEISHI K.K., a Japanese corporation. Each layer of layers 3 is wood pulp fiber 70%, rayon fiber 15%, and other fibers 15% in composition, 40 gram/m$^2$ in weight, and 0.14 mm in thickness. To provide another example, each layer of layers 3 can be a blotting paper made by HONSHU SEISHI K.K., a Japanese corporation, which is 100% pulp in composition, 60 gram/m$^2$ in weight, and 0.2 mm in thickness. Oil absorbing layer 1 also has plural layers 4 of a non-woven fabric named KINOKUROSU made by HONSHU KINOKUROSU K.K., a Japanese corporation. Each layer of layers 4 is 100% wood pulp in composition, 40 gram/m$^2$ in weight, and 1.0 mm in thickness. To provide another example, each layer of layers 4 is an artificial leather named CLARINO- VELOUR TYPE made by K.K. Kurare, a Japanese corporation. This artificial leather is substantially 100% nylon, 530 gram/m$^2$ in weight, and 1.5 mm in thickness.

In the embodiments as noted above, each paper for layers 3 contains a large number of wood fibers extending in the axial direction of the core 2. As is well known, a fiber has an outstanding liquid guiding ability due to capillarity. Accordingly, each layer of layers 3, serves for diffusing oil in the axial direction of core 2. A nonwoven fabric or an artificial leather for layers 4 is composed of a homogeneous soft material containing numerous fine spaces or small pores scattered throughout said material. These spaces or pores communicate to the faces of layer 4 and with one another. Accordingly, each layer 4, as an oil retaining layer, serves for absorbing and retaining oil therein due to capillarity of these fine spaces or pores communicating with one another.

Oil absorbing layer 1 may be formed on core 2 by coiling round core 2 a double layer composed of single layer 3 and single layer 4 laid one upon the other. This results in layers 3 and 4 being present alternately in oil absorbing layer 1 in such a manner as shown in FIG. 3. In an embodiment as shown, several sheets of paper 3 are present for the outer layers of oil absorbing layer 1. This can be achieved by coiling the aforesaid double layer composed of the paper layer much longer than the other layer. This is advantageous for providing a good oil diffusing property in the axial direction. It is apparent that each layer of oil diffusing layers 3 and oil retaining layers 4 may be formed in an independent cylindrical layer, not in coiled layers. It is also apparent that each layer of oil diffusing layers 3 or oil retaining layers 4 may also be formed with a number of layers, one laid upon another.

According to this invention, as the oil absorbing layer is composed of oil diffusing layers and oil retaining layers, each of said oil diffusing layers containing fibrous bodies extending in the axial direction, and each of said oil retaining layers being composed of a homogeneous soft and porous material containing numerous fine spaces or pores scattered throughout said material and communicating to the faces of said layer and with one another, oil, applied to any portion of the cylindrical face of said roller is guided by said fibrous bodies and diffused in he axial direction of the roller so as to be absorbed and retained by said oil retaining layer which lies adjacent to said oil diffusing layer at every portion located along said axial direction. The oil which has been absorbed and retained by said oil retaining layer wets, prior to saturation with oil, and oil diffusing layer which lies adjacent to said oil retaining layer. As noted above, offset preventive oil, upon being applied to the cylindrical face of said roller, is diffused rapidly throughout said oil absorbing layer and retained uniformly in said oil absorbing layer. Accordingly, every portion of the cylindrical face of said roller is always kept dry prior to the whole body of said oil absorbing layer being saturated with oil. The oil absorbing layer may be at least five times as thick as the oil diffusing layer.

Figure 1:
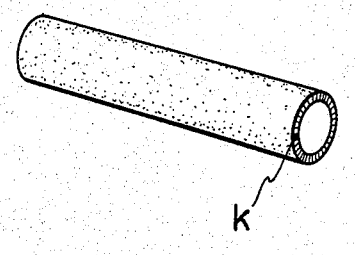
FIG. 1 Prior Art
FIG. 1 is an oblique perspective view of a prior art roller subsidiary to the fixing roller for electronic copying machines.
Figure 2:
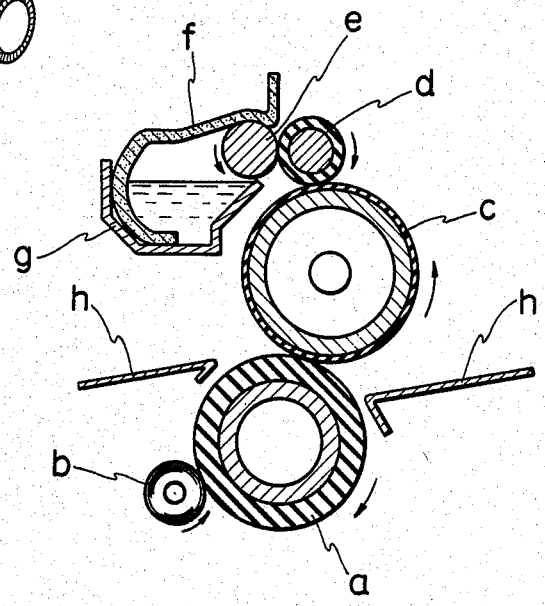
FIG. 2 is a schematic vertical sectional view of the principal part of an electronic copying machine having a roller subsidiary to a fixing roller.

As stated above, as the absorbing layer as a whole keeps absorbing oil until the whole body is saturated, the life relative to the number of times of use is very long as compared with such a subsidiary roller of the prior art. According to our experiments, a roller of the prior art such as shown in FIG. 1 having a foamed urethane rubber oil absorbing layer was observed, after several thousand copying operations using a copying paper having a smaller width, to be unqualified for use for copying papers having larger widths due to taint at the side edge portions thereof. On the contrary, using such a subsidiary roller according to this invention the above-noted number of times was found to permit several tens of thousands of copies to be made before taint of papers occurred.

In consequence, according to this invention, a subsidiary roller for fixing rollers having a very long life and an excellent ability of wiping off oil can be provided economically. This undoubtedly will make a large contribution to improvements in performance of electronic copying machines.

What we claim is:

1. In an offset preventive diffusing roller subsidiary to a fixing roller for electronic copying machines having a cylindrical oil absorbing layer fixed around a cylindrical solid core which is to be supported at both ends thereof, an improvement which comprises;

said oil absorbing layer comprises oil diffusing layers and oil retaining layers, each of said oil diffusing layers having fibrous bodies extending in the axial direction of said core, and each of said oil retaining layers being composed of a homogeneous soft and porous material containing therein numerous fine spaces communicating with one another and to the outer face of said layer and scattered throughout said material.

2. An offset preventive diffusing roller subsidiary to a fixing roller for electronic copying machines as claimed in claim 1 in which said oil diffusing layers and said oil retaining layers are disposed in such a manner that a single oil diffusing layer and a single oil retaining layer are laid radially one upon the other in a major portion of said oil absorbing layer.

3. An offset preventive diffusing roller subsidiary to a fixing roller for electronic copying machines as claimed in claims 1 or 2 in which layers in the outermost portion of said oil absorbing layer comprise exclusively a number of said oil diffusing layers.

4. An offset preventive diffusing roller subsidiary to a fixing roller for electronic copying machines as claimed in claim 3 in which said oil absorbing layer, at least in a major portion, comprises a coil of a double layer composed of said oil diffusing layer and said oil retaining layer laid one upon the other.

5. An offset preventive diffusing roller subsidiary to a fixing roller for electronic copying machines as claimed in claim 4 in which said oil diffusing layer is composed of a long fiber wood pulp paper and said oil retaining layer is composed of a material selected from a nonwoven fabric and an artificial leather.

6. An offset preventive diffusing roller subsidiary to a fixing roller for electronic copying machines as claimed in claim 3 in which said oil diffusing layer is composed of a long fiber wood pulp paper and said oil retaining layer is composed of a material selected from a nonwoven fabric and an artificial leather.

7. An offset preventive diffusing roller subsidiary to a fixing roller for electronic copying machines as claimed in claims 1 or 2 in which said oil absorbing layer, at least in a major portion, comprises a coil of a double layer composed of said oil diffusing layer and said oil retaining layer laid one upon the other.

8. An offset preventive diffusing roller subsidiary to a fixing roller for electronic copying machines as claimed in claims 1 or 2 in which said oil diffusing layer is composed of a long fiber wood pulp paper and said oil retaining layer is composed of a material selected from a non-woven fabric and an artificial leather.

9. An offset preventive diffusing roller subsidiary to a fixing roller for electronic copying machines as claimed in claims 1 or 2 in which said oil diffusing layer is very small in thickness as compared with said oil retaining layer.

10. An offset preventive diffusing roller subsidiary to a fixing roller for electronic copying machines as claimed in claim 9 in which said oil retaining layer is at least five times as thick as said oil diffusing layer.

11. An offset preventive diffusing roller subsidiary to a fixing roller for electronic copying machines as claimed in claim 10 in which said oil diffusing layer is composed of a long fiber wood pulp paper and said oil retaining layer is composed of a material selected from a non-woven fabric and an artificial leather.

* * * * *